US007415221B2

(12) United States Patent
Parisi et al.

(10) Patent No.: US 7,415,221 B2
(45) Date of Patent: Aug. 19, 2008

(54) MODULAR MEDIA REGISTRATION SYSTEMS AND METHODS FOR PRINTING OR IMAGE-FORMING APPARATUS

(75) Inventors: Russell A. Parisi, Williamson, NY (US); David Cipolla, Macedon, NY (US); Donald Johnston, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 11/294,855

(22) Filed: Dec. 6, 2005

(65) Prior Publication Data

US 2007/0127945 A1 Jun. 7, 2007

(51) Int. Cl.
*G03G 15/00* (2006.01)

(52) U.S. Cl. ..... 399/107; 399/110; 399/301; 399/391; 271/227

(58) Field of Classification Search ..... 399/107, 399/110, 13, 18, 301, 391, 393, 394, 395, 399/396; 271/227, 228, 226
See application file for complete search history.

(56) References Cited

U.S. PATENT DOCUMENTS 5,278,624 A 1/1994 Kamprath et al.
5,848,344 A * 12/1998 Milillo et al. ..... 399/395
6,032,004 A 2/2000 Mirabella, Jr. et al.
6,173,952 B1 * 1/2001 Richards et al. ..... 271/228
6,533,268 B2 * 3/2003 Williams et al. ..... 271/228
2004/0109699 A1 * 6/2004 Skrainar et al. ..... 399/9
2004/0251607 A1 12/2004 Mandel et al.

* cited by examiner

*Primary Examiner*—David M Gray
*Assistant Examiner*—Geoffrey T Evans
(74) *Attorney, Agent, or Firm*—Gibb & Rahman, LLC

(57) ABSTRACT

Embodiments herein comprise registrations module(s) positioned between image output terminal(s), feeder module(s), and/or finisher module(s). Each registration module comprises a casing having first mounting points that correspond to second mounting points on an adjacent module. The first mounting points and the second mounting points allow the registration module to be repeatedly connected to and disconnected from an adjacent module. Each registration module also includes sensors within the casing, a controller operatively connected to the sensors, and sheet feeders. The sensors determine alignment characteristics of media passing through the module and the controller is adapted to correct the alignment characteristics of the media through unequal rotation of the sheet feeders, if the alignment characteristics deviate from a predetermined standard.

12 Claims, 5 Drawing Sheets

MODULAR MEDIA REGISTRATION SYSTEMS AND METHODS FOR PRINTING OR IMAGE-FORMING APPARATUS

BACKGROUND

Embodiments herein generally relate to toner image production machines, and more particularly, concerns modular toner image production machines. The apparatus includes image output terminal(s), feeder module(s), finisher module(s), and one or more registration module(s).

U.S. Patent Application Publication 2004/0109699, the disclosure of which is incorporated herein by reference in its entirety, discloses that in a typical toner image production machine, such as an electrostatographic reproduction machine, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This process records an electrostatic latent image on the photoconductive member corresponding to the informational areas contained within the original document. After the electrostatic latent image is recorded on the photoconductive member, the latent image is developed by bringing a developer material into contact therewith.

Generally, the developer material is made from toner particles adhering triboelectrically to carrier granules. The toner particles are attracted from the carrier granules to the latent image forming a toner powder image on the photoconductive or image bearing member. The toner powder image is then transferred at an image transfer station, from the photoconductive member, to a copy substrate such as a copy sheet of paper.

Thereafter, heat or some other treatment is applied to the toner particles at a fusing station to permanently fuse and affix the toner powder image to the copy sheet or substrate. The copy sheet or substrate typically is fed automatically from a stack supply thereof, along a sheet transport path that includes a sheet registration subassembly, to the image transfer station where the toner image is transferred from the image bearing member onto a first side of the copy sheet. As discussed above, after such toner image transfer, the copy sheet is moved along the sheet path to the fusing station of the machine where the toner image is fused and affixed to the copy sheet. In machines with duplex copying capability, the sheet path usually includes a sheet inverter, and the copy sheet after leaving the fusing station, is inverted at the inverter and re-fed to the transfer station in proper orientation for receiving a second toner image on a second side of the copy sheet. In either case, the copy sheet with the fused toner image or images on it is then forwarded to an output tray or finishing station. High quality output copies typically require proper and high quality registration of the toner image or images on the copy sheet.

To achieve such registration, the copy sheet must be transported in a timed and registered manner to the sheet registration subassembly and to the transfer station each time, and sheet drive mechanisms along the sheet path have to function without slippage. Presence and proximity sensors can be used for assisting the achievement of such proper and timed registration of each copy sheet.

SUMMARY

Embodiments herein comprise a printing apparatus (e.g., an electrostatographic and a xerographic machine, etc.). The apparatus includes image output terminal(s), feeder module(s), finisher module(s), and one or more registration module(s) connected to one another. In one embodiment, the registrations modules are positioned between the image output terminal(s), the feeder module(s), and/or the finisher module(s). Each registration module comprises a casing having first mounting points that correspond to second mounting points on an adjacent module. The first mounting points and the second mounting points allow the registration module to be repeatedly connected to and disconnected from an adjacent module. Each registration module also includes sensors within the casing, a controller operatively connected to the sensors, and sheet feeders. The sensors determine alignment characteristics of media passing through the module and the controller is adapted to correct the alignment characteristics of the media through unequal rotation of the sheet feeders, if the alignment characteristics deviate from a predetermined standard.

The registration module further comprises first electrical connections, wherein the first electrical connections are adapted to contact second electrical connections on the adjacent module. The first electrical connections and the second electrical connections are adapted to transmit power and/or data signals. The first mounting points and the second mounting points comprise non-permanent connections and can comprise any appropriate connector. The registration module comprises an independent stand-alone apparatus.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

While the present method and structure will be described in connection with preferred embodiments thereof, it will be understood that this disclosure is not limited to the disclosed embodiments. On the contrary, this disclosure is intended to cover all alternatives, modifications, and equivalents as may be included within the spirit and scope, as defined by the appended claims.

Figure 1:
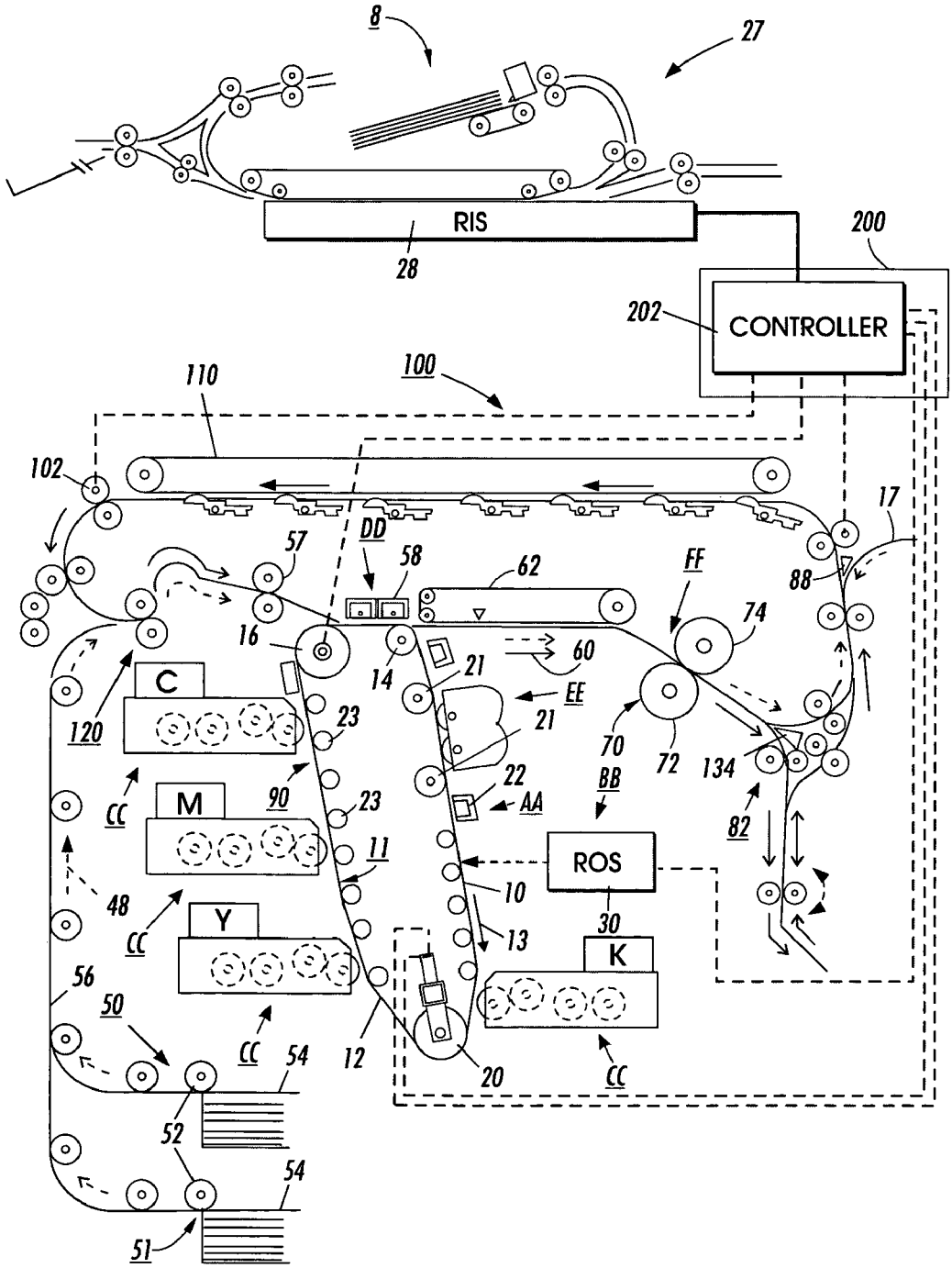
FIG. 1 is a schematic representation of an image producing machine such as an electrostatographic reproduction machine.

FIG. 1, schematically illustrates a toner image producing machine such as a copier, printer, or multifunction device shown in the form of an electrostatographic reproduction machine 8 which is sometimes referred to herein as an image outputting terminal (IOT). In the machine 8, an original document is positioned in a document handling module 27 on a raster input scanner (RIS) module indicated generally by reference numeral 28. The RIS module 28, for example, contains document illumination lamps, optics, a mechanical scanning drive and a charge coupled device (CCD) array. The RIS module 28 operates to capture the entire original document and converts it to a series of raster scan lines. This information is transmitted to a control module 200 that includes an electronic subsystem (ESS) 202 that controls a raster output scanner (ROS) 30.

The machine 8 generally employs a photoreceptor module 90 including a photoconductive member shown as a belt 10. The photoconductive belt 10 can be made from a photoconductive material coated on a ground layer which, in turn, is coated on an anti-curl backing layer. The belt 10 moves in the direction of arrow 13 to advance successive portions sequentially through the various processing stations disposed about the path of movement thereof. Belt 10 is entrained as a closed loop 11 about a stripping roll 14, a drive roll 16, and an idler roll 21.

Initially, a portion of the photoconductive belt surface passes through a charging station AA. At the charging station AA, a corona generating device indicated generally by the reference numeral 22 charges the photoconductive belt 10 to a relatively high, substantially uniform potential.

Still referring to FIG. 1, at an exposure station BB, the controller or electronic subsystem (ESS) 202, receives image signals from the RIS 28 representing the desired output image and processes these signals to convert them to a continuous tone or gray scale rendition of the image which is transmitted to a modulated output generator, for example the raster output scanner (ROS), indicated generally by reference numeral 30.

The ROS 30 includes a laser with rotating polygon mirror blocks. For example, a nine-facet polygon could be used. The ROS 30 illuminates the charged portion on the surface of the photoconductive belt 10 at a resolution of about 300 or more pixels per inch. The ROS will expose the photoconductive belt 10 to record an electrostatic latent image thereon corresponding to the continuous tone image received from the ESS 202. As an alternative, the ROS 30 may employ a linear array of light emitting diodes (LEDs) arranged to illuminate the charged portion of the photoconductive belt 10 on a raster-by-raster basis.

After the electrostatic latent image has been recorded on the photoconductive surface 12, the belt 10 advances the latent image to a development station CC, which includes four development modules as shown each having developer units containing CMYK color toners, in the form of liquid or dry particles. As is well known, the CMYK color toners are electrostatically attracted to the latent images using commonly known techniques.

With continued reference to FIG. 1, after the electrostatic latent image is developed, the toner powder image present on the belt 10 advances to the transfer station DD. A print sheet 48 is advanced to the transfer station DD, by a sheet feeding module or apparatus 50, 51. The sheet feeding apparatus 50, 51 includes a feed roll 52 contacting the uppermost sheet of the stack 54. The feed roll 52 rotates to advance the uppermost sheet from the stack 54 to the sheet transport 56. The sheet transport 56 directs the advancing sheet 48 of support material into the registration assembly 57 and then into the image transfer station DD to receive a toner image from the photoreceptor belt 10 in a timed sequence. The toner image on the image bearing surface 12 of the belt 10 contacts the advancing sheet 48 at transfer station DD. The transfer station DD includes a corona-generating device 58, which sprays ions onto the backside of sheet 48. This attracts the toner image from the photoconductive surface 12 to the sheet 48. After image transfer as such, the sheet 48 continues to move in the direction of arrow 60 by way of the belt transport 62, which advances the sheet 48 to the fusing station FF.

The fusing station FF includes a fusing module indicated generally by the reference numeral 70 which permanently affixes the transferred toner power image to the copy sheet. The fusing module 70 includes a heated fuser roller 72 and a pressure roller 74 with the powder image on the copy sheet contacting fuser roller 72. The pressure roller is biased against the fuser roller to provide the necessary pressure to fix the toner powder image to the copy sheet. The fuser roll is internally heated by a quartz lamp (not shown). A release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through the fusing module 70 where the image is permanently fixed or fused to the sheet. After passing through the fusing module 70, a gate 88 either allows the sheet to move directly via an output 17 to a finisher or stacker, or deflects the sheet into the duplex path 100, specifically, first into a single sheet inverter 82. That is, if the second sheet is either a simplex sheet, or a completed duplexed sheet having both side one and side two images formed thereon, the sheet will be conveyed via gate 88 directly to the output finishing modules (260, 262 FIG. 2) via output path 17.

However, if the sheet is being duplexed and is then only printed with a side one image, the gate 88 will be positioned to deflect that sheet into the inverter 82 and into the duplex loop path 100, where that sheet will be inverted and then fed to the acceleration nip 102 and belt transports 110, for recirculation back through the transfer station DD and the fusing module 70 for receiving and permanently fixing the side two image to the backside of that duplex sheet, before it exits via the exit path 17.

After the print sheet is separated from the photoconductive surface 12 of the belt 10, the residual toner/developer and paper fiber particles adhering to photoconductive surface 12 are removed therefrom at a cleaning station EE. The cleaning station EE includes a rotatably mounted fibrous brush in contact with the photoconductive surface 12 to disturb and remove paper fibers and a cleaning blade to remove the non-transferred toner particles. The blade may be configured in either a wiper or doctor position depending on the application. Subsequent to cleaning, a discharge lamp (not shown) floods the photoconductive surface 12 with light to dissipate any residual electrostatic charge remaining thereon prior to the charging thereof for the next successive imaging cycle.

Figure 2:
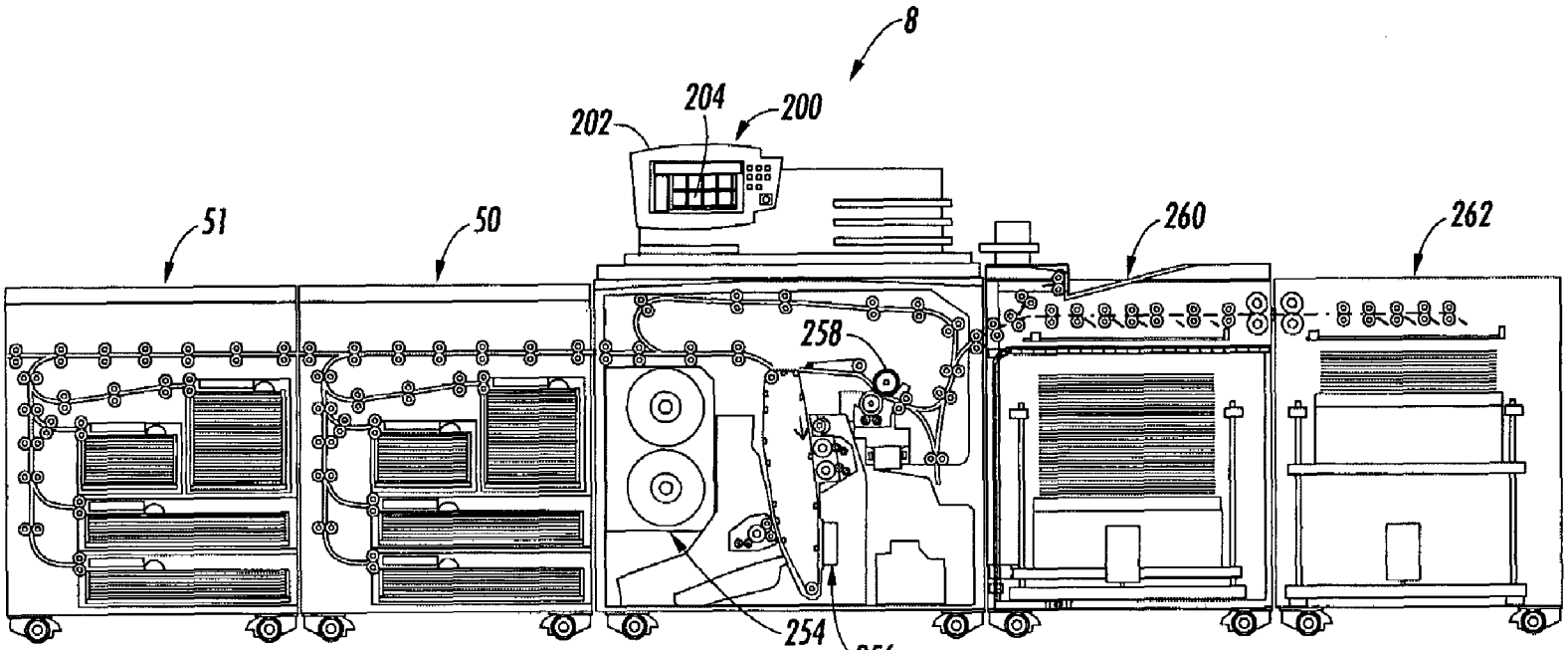
FIG. 2 is a schematic representation of a modular image producing machine.

As shown FIGS. 1-2, the reproduction machine 8 includes a control module 200 including the electronic control subsystem (ESS) 202 having a centrally located user interface (UI) 204. The modular machine 8 for example has modular sheet feeding modules 50, 51, a development module 254 and a photoreceptor module 256. It also includes a fusing module 258, and modular hard copy finishing modules 260 and 262. While two sheet feeding modules 50, 51 and two finishing modules 260, 262 are illustrated in FIG. 2, any number of sheet feeding modules and finishing modules could be utilized with embodiments herein. The modules 51, 51, 260, 262, can be repeatedly attached/detached from each other and from the IOT 8 depending upon the configuration desired by the user.

Due to the modular nature of the device shown in FIG. 2, there are many combinations of input and output devices available. This modularity gives the user the ability to easily alter feeder capacity and finishing capability depending upon their individual needs. One issue with modular devices is that the only paper registration occurs within the image output terminal 8. Therefore, the device shown in FIG. 2 does not have the ability to perform registration corrections that occur within the finishing modules 260, 262. In addition, it may be difficult for the single registration unit included within the image output terminal 8 to handle large registration errors that can occur when multiple feeder modules 50, 51 are utilized.

Figure 3:
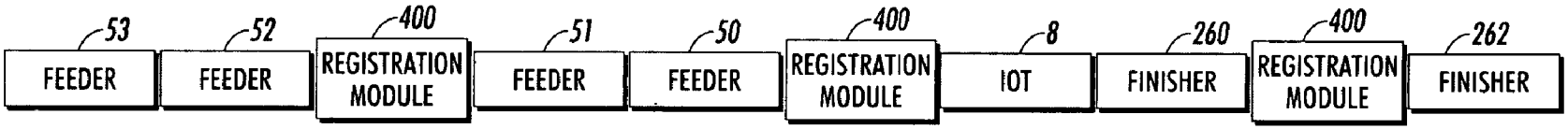
FIG. 3 is a schematic representation of a modular image producing machine.

In order to address these issues, the embodiment shown in FIG. 3 includes one or more modular registration units 400 that can be attached to one or more of the feeder modules 50, 51, attached to one or more of the finishing modules 260, 262, and/or attached to the image output terminal 8. The registration units 400 receive media sheets from a preceeding (upstream) adjacent module (8, 50-53, 260-262, etc.), align the media sheets and then pass the media sheets to a succeeding (downstream) adjacent module (8, 50-53, 260-262, etc.). More specifically, the embodiment shown in FIG. 3 includes four feeder units 50-53 and two finisher units 260, 262. In addition, three modular registration modules 400 are included in the structure. The registration modules 400 can be positioned at any location deemed appropriate by the user, and in this example the registration modules are placed between two of the feeder units, between two of the finisher units and between one of the feeder units and the image output terminal. While three registration modules 400 are illustrated in FIG. 3, any number of registration modules 400 could be utilized. For example, the number of registration modules 400 could range from only a single registration module to registration modules between each of the feeder units, each of the finisher units, and on both sides of the input output terminal.

Figure 4:
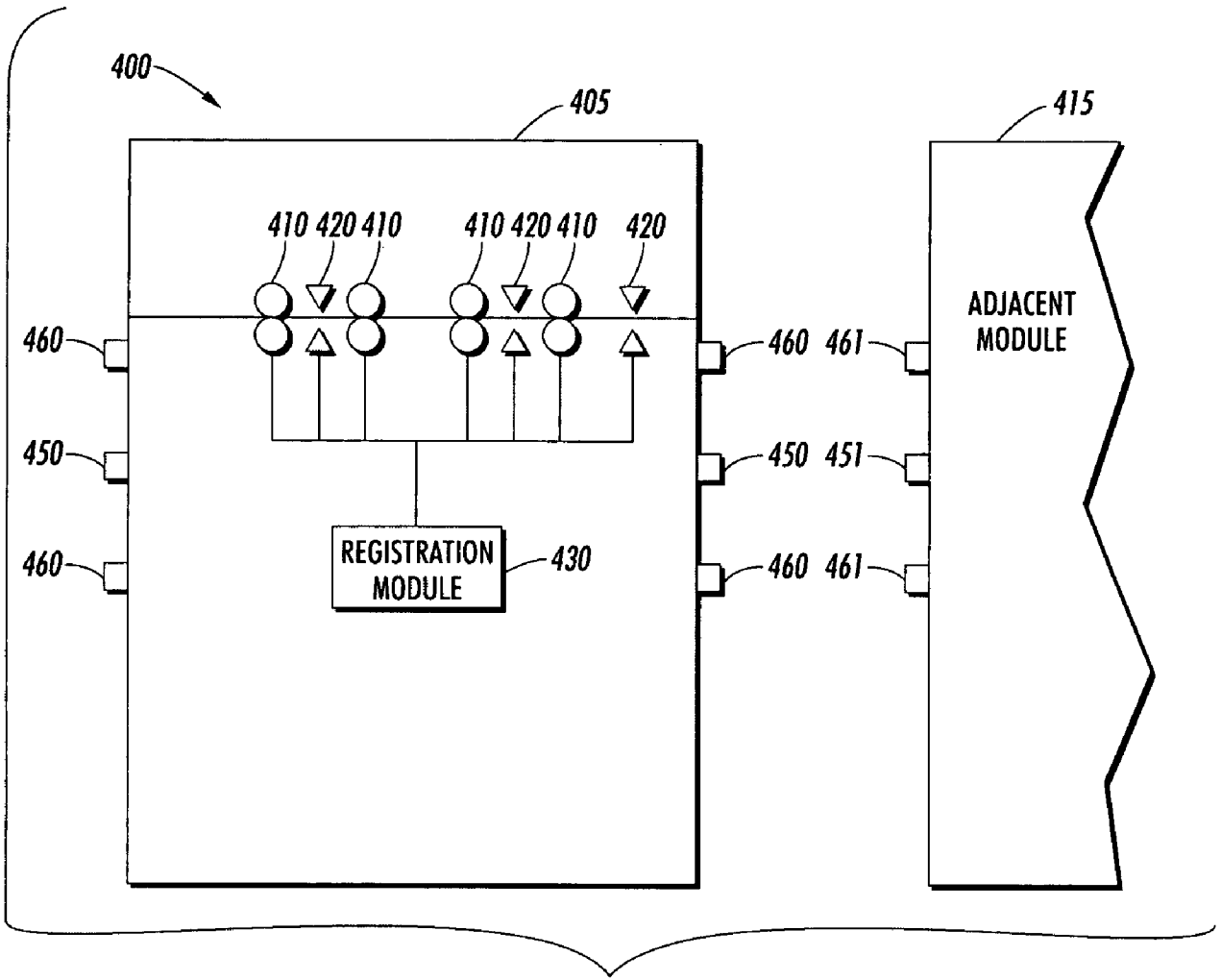
FIG. 4 is a schematic representation of a modular registration unit.

FIG. 4 illustrates one embodiment of the registration module 400 in greater detail. As shown in FIG. 4, the registration module comprises a casing 405 having first mounting points 460 that correspond to second mounting points 461 on an adjacent module 415. The adjacent module 415 can comprise any of the feeder modules 50-53, the input output terminal 8, and/or any of the finisher modules 260, 262. The first mounting points 460 and the second mounting points 461 allow the registration module to be repeatedly connected to and disconnected from the adjacent module 415.

The registration module 400 further comprises first electrical connections 450, wherein the first electrical connections 450 are adapted to contact second electrical connections 451 on the adjacent module 415. The first electrical connections 450 and the second electrical connections 451 are adapted to transmit power and/or data signals. The first mounting points 460 and the second mounting points 461 comprise non-permanent connections. The mounting points 460, 461 can comprise any appropriate connector, such as bolts, screws, latches, snaps, belts, pins, catches, hooks, cables, protrusions, openings, slots, etc. The registration module 400 comprises an independent stand-alone apparatus.

Each registration module also includes sensors 420 within the casing, a controller 430 operatively connected to the sensors 420, and sheet feeders 410. The sensors 420 determine alignment characteristics of media passing through the module and the controller 430 is adapted to correct the alignment characteristics of the media through unequal rotation of the sheet feeders 410, if the alignment characteristics deviate from a predetermined standard. The embodiments herein can use any currently available electronic registration system, or those developed in the future. For example, some current registrations systems use unequal application of drive nips to control the media alignment during registration, e.g., see U.S. Pat. Nos. 6,533,268; 5,278,624 and U.S. Publication number 2004/0251607 (and the patents and publications referred to therein) the complete disclosures of which are incorporated herein by reference.

Figure 5:
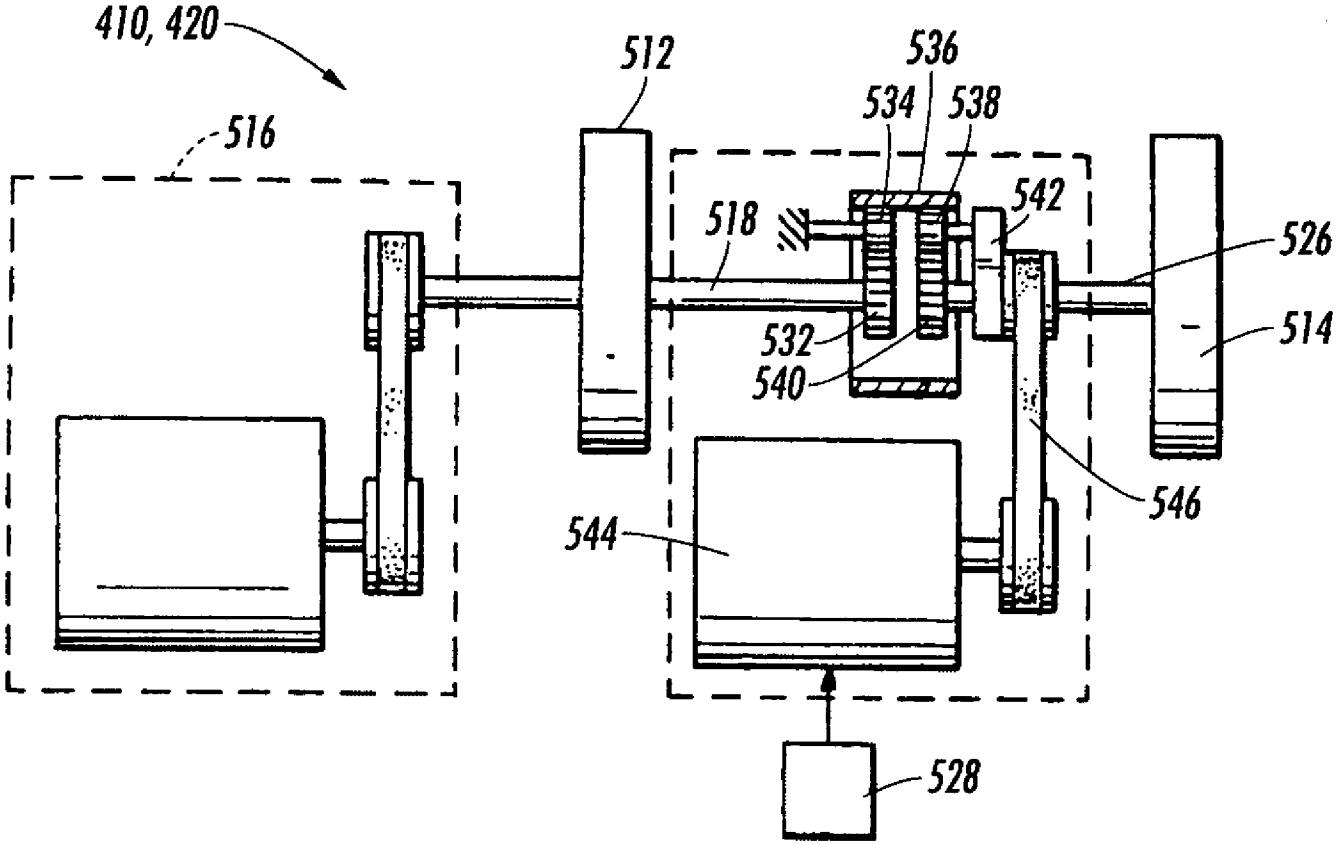
FIG. 5 is a schematic representation of a sensor/drive deskew assembly.

One example of a sensor/drive nip de-skew assembly 410, 420 is shown in greater detail in FIG. 5. In FIG. 5, the sensor/drive de-skew assembly 410, 420 includes the drive nip rolls 512 and 514. The roll 512 is mounted on shaft 518 which is driven by the drive 516. The roll 514 is mounted on a shaft 526, the axis of rotation of which is coincident with the axis of rotation of the shaft 518. In this embodiment, the differential drive means includes a spur gear 532 fixed to an end of shaft the 518 opposite the drive 516, a fixed position idler gear 534, a ring gear 536, a planet gear 538 and a sun gear 540. The sun gear 540 is fixed onto one end of the shaft 526. The planet gear 538 is carried on a rotatable planetary arm 542, that is mounted for rotation about the shaft 526. Thus, the axis of rotation of the planet gear 538 can be moved about the axis of the shaft 526. A motor 544, preferably a stepping motor, drives the planetary arm 542 by a suitable transmission system 546, to rotate about the axis of rotation of the shaft 526.

In a sheet translating mode, the rolls 512 and 514 are driven at the same speed by the differential system comprising the gears 532, 534, 536, 538 and 540. In this condition, the motor 544, which is not being driven, holds arm 542 in place through the transmission 546. In a de-skew mode, the controller 528 provides pulses of appropriate number and direction to the motor 544 to rotate the planetary arm 542 in an appropriate direction and by an appropriate amount about the axis of shaft 526 to correct for the skew. If the arm 542 is moved in the direction of rotation of ring gear 536, the angular position of roll 512 is advanced with respect to roll 514. If the arm 542 is moved counter to the direction of rotation of ring gear 536, roll 514 is angularly advanced with respect to roll 512. By such relative angular shifting of the rolls 512 and 514, the skew of the copy sheet is controlled.

The word "printer" or "image output terminal" as used herein encompasses any apparatus, such as a digital copier, bookmaking machine, facsimile machine, multi-function machine, etc. which performs a print outputting function for any purpose. The details of printers, printing engines, etc. are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A module operatively connectable to an apparatus, said module comprising:

a casing having first mounting points, wherein said first mounting points correspond to second mounting points on said apparatus, and wherein said first mounting points and said second mounting points allow said casing to be repeatedly connected to and disconnected from said apparatus;

sensors within said casing, wherein said sensors are adapted to determine alignment characteristics of media passing through said module;

a controller operatively connected to said sensors; and sheet feeders within said casing and operatively connected to said controller, wherein said controller is adapted to correct said alignment characteristics of said media through unequal rotation of said sheet feeders if said alignment characteristics deviate from a predetermined standard, wherein said module is independent of said apparatus to which said module is connectable, and wherein said registration module comprises a stand-alone apparatus limited to performing only sheet registration operations.

2. The module according to claim 1, wherein said casing further comprises first electrical connections, wherein said first electrical connections are adapted to contact second electrical connections on said apparatus.

3. The module according to claim 2, wherein said first electrical connections and said second electrical connections are adapted to transmit at least one of power and data signals.

4. A printing apparatus comprising:

an image output terminal; and a registration module operatively connected to said image output terminal, said registration module comprising:

a casing having first mounting points, wherein said first mounting points correspond to second mounting points on said image output terminal, and wherein said first mounting points and said second mounting points allow said registration module to be repeatedly connected to and disconnected from said image output terminal;

sensors within said casing, wherein said sensors are adapted to determine alignment characteristics of media passing through said registration module;

a controller operatively connected to said sensors; and sheet feeders within said casing and operatively connected to said controller, wherein said controller is adapted to correct said alignment characteristics of said media through unequal rotation of said sheet feeders if said alignment characteristics deviate from a predetermined standard, wherein said registration module is independent of said image output terminal, and wherein said registration module comprises a stand-alone apparatus limited to performing only sheet registration operations.

5. The apparatus according to claim 4, wherein said casing further comprises first electrical connections, wherein said first electrical connections are adapted to contact second electrical connections on said image output terminal.

6. The apparatus according to claim 5, wherein said first electrical connections and said second electrical connections are adapted to transmit at least one of power and data signals.

7. A printing apparatus comprising:

at least one image output terminal;

at least one feeder module operatively connected to said image output terminal;

at least one finisher module operatively connected to said image output terminal; and at least one registration module connected to at least one of said image output terminal, said feeder module, and said finisher module, wherein said registration module comprises:

a casing having first mounting points, wherein said first mounting points correspond to second mounting points on said image output terminal, and wherein said first mounting points and said second mounting points allow said casing to be repeatedly connected to and disconnected from one of said image output terminal, said feeder module, and said finisher module;

sensors within said casing, wherein said sensors are adapted to determine alignment characteristics of media passing through said module;

a controller operatively connected to said sensors; and sheet feeders within said casing and operatively connected to said controller, wherein said controller is adapted to correct said alignment characteristics of said media through unequal rotation of said sheet feeders if said alignment characteristics deviate from a predetermined standard, wherein said registration module is independent of said image output terminal, said feeder, and said finisher, and wherein said registration module comprises a stand-alone apparatus limited to performing only sheet registration operations.

8. The apparatus according to claim 7, wherein said casing further comprises first electrical connections, wherein said first electrical connections are adapted to contact second electrical connections on said image output terminal, said feeder module, and said finisher module.

9. The apparatus according to claim 8, wherein said first electrical connections and said second electrical connections are adapted to transmit at least one of power and data signals.

10. A printing apparatus comprising:

at least one image output terminal module;

at least one feeder module operatively connected to said image output terminal;

at least one finisher module operatively connected to said image output terminal; and a plurality of registration modules positioned between at least one of said image output terminal module, said feeder module, and said finisher module, wherein each of said registration modules comprises:

a casing having first mounting points, wherein said first mounting points correspond to second mounting points on said image output terminal, and wherein said first mounting points and said second mounting points allow said casing to be repeatedly connected to and disconnected from one of said image output terminal, said feeder module, and said finisher module;

sensors within said casing, wherein said sensors are adapted to determine alignment characteristics of media passing through said module;

a controller operatively connected to said sensors; and sheet feeders within said casing and operatively connected to said controller, wherein said controller is adapted to correct said alignment characteristics of said media through unequal rotation of said sheet feeders if said alignment characteristics deviate from a predetermined standard, wherein said registration modules are independent of said image output terminal, said feeder, and said finisher, and wherein said registration module comprises a stand-alone apparatus limited to performing only sheet registration operations.

11. The apparatus according to claim 10, wherein said casing further comprises first electrical connections, wherein said first electrical connections are adapted to contact second electrical connections on said image output terminal, said feeder module, and said finisher module.

12. The apparatus according to claim 10, wherein said printing apparatus comprises at least one of an electrostatographic and a xerographic machine.

* * * * *